United States Patent [19]

Åkerberg

[11] 4,056,053

[45] Nov. 1, 1977

[54] COMPACTORS, PARTICULARLY FOR GARBAGE

[75] Inventor: Olof Robert Wilhelm Åkerberg, Vetlanda, Sweden

[73] Assignee: Aktiebolaget Electrolux, Stockholm, Sweden

[21] Appl. No.: 622,071

[22] Filed: Oct. 14, 1975

Related U.S. Application Data

[63] Continuation-in-part of Ser. No. 558,369, March 14, 1975, abandoned, which is a continuation of Ser. No. 353,085, April 20, 1973, abandoned.

[30] Foreign Application Priority Data

Apr. 24, 1972 Sweden ..... 5343/72

[51] Int. Cl.[2] ..... B30B 15/32

[52] U.S. Cl. ..... 100/218; 53/124 TS; 100/226; 100/229 A

[58] Field of Search ..... 53/124 B, 124 TS; 141/73, 80, 313–317, 10, 71, 114; 100/218, 226, 227, 240, 228, 229 A, 229 R, 249, 250, 251

[56] References Cited

U.S. PATENT DOCUMENTS

| | | | |
|---|---|---|---|
| 155,329 | 9/1874 | Milner | 100/229 R |
| 2,757,603 | 8/1956 | Wilson et al. | 100/226 |
| 2,970,533 | 2/1961 | Allen | 100/226 |
| 3,528,366 | 9/1970 | Neuenburg et al. | 100/218 |
| 3,659,427 | 5/1972 | Harza | 100/218 |
| 3,722,561 | 3/1973 | O'Leary | 53/124 B |
| 3,785,278 | 1/1974 | Hopkins | 100/229 A |

*Primary Examiner*—Billy J. Wilhite

[57] ABSTRACT

A compactor, particularly for garbage, especially for use in homes and apartment houses, comprising a tubular receptacle having at its top a pressure plate adapted to occupy a position at the upper end of the tubular receptacle, in which position the pressure plate forms a cover for the receptacle and from this position the plate is reciprocably movable into the receptacle, and a position removed from the receptacle, so that the upper end of the receptacle is uncovered, and means for pivoting the receptacle clear of a bottom plate so that compacted matter accumulated in the receptacle can be pressed out by means of the pressure plate through the lower end of the receptacle into a bag disposed over said lower end.

2 Claims, 4 Drawing Figures

FIG. 2
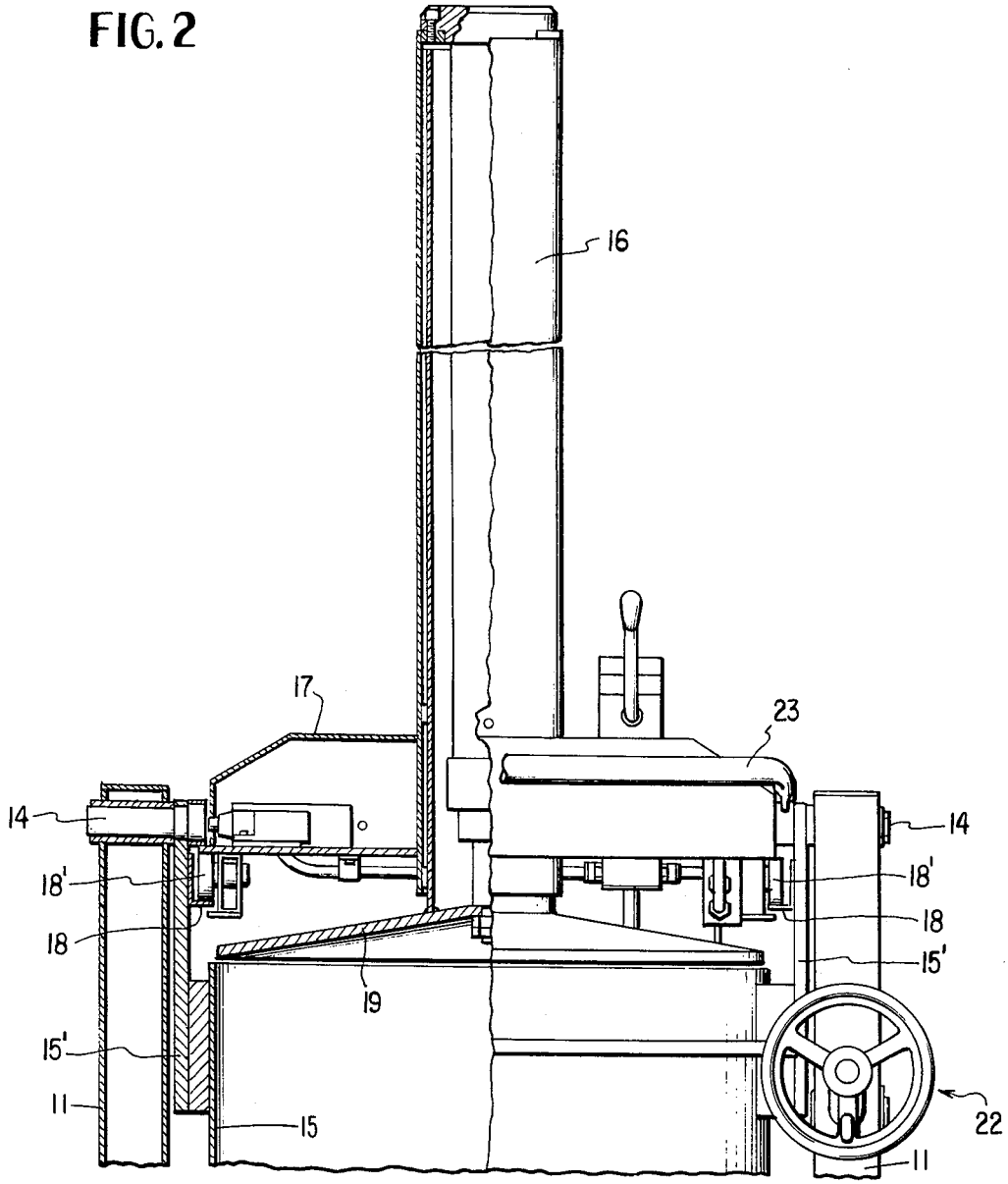
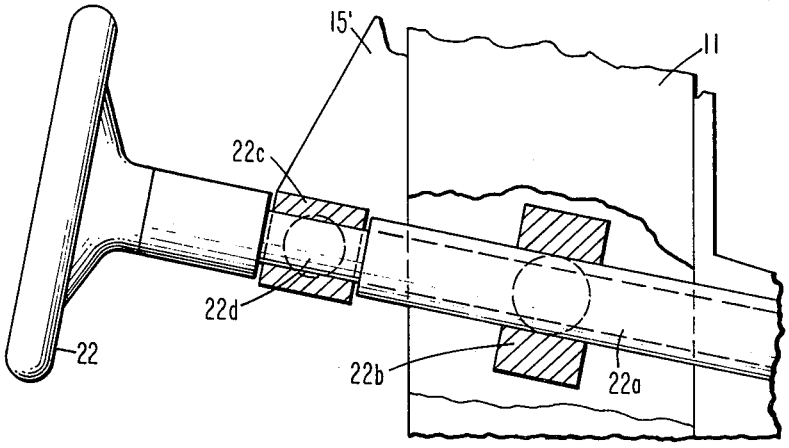
FIG. 2a

COMPACTORS, PARTICULARLY FOR GARBAGE

This application is a continuation-in-part application of application Ser. No. 558,369, filed Mar. 14, 1975, now abandoned, which is a continuation of application Ser. No. 353,085 filed Apr. 20, 1973, now abandoned.

The present invention relates to a compactor, particularly for gargage, comprising a support, a tubular element carried by said support, pressing means having a pressure plate reciprocable into the tubular element, and a bottom plate against which the pressure plate acts for compacting purposes.

In garbage compactors of this type, emptying often gives rise to problems. According to one proposed solution, on removal of the bottom plate, the tubular element or garbage receptacle is moved upwards against a fixed pressure plate which, as it enters the ascending receptacle, presses the material therein out through the open lower end of the receptacle and into a bag passed over this end. According to another solution, the pressure plate is brought to bear against the upper surface of the compacted matter at the same time as the bottom plate is detached from the tubular element. During continued actuation of the pressure plate, the receptacle is moved upwards while pulling a bag over the compacted matter, which bag was passed over the receptacle. In the first-mentioned device there is a risk that the accumulated compacted matter in the receptacle will slide downwards by gravity while taking the bag with it and, moreover, this device is complicated, bulky and expensive. The latter device is satisfactory in operation but the mounting of the receptacle, which is normally of the telescopic type, is complicated and thus expensive.

The present invention has for its primary object to facilitate emptying of receptacles of the above type by a simple and less expensive means. This object is realized in that the pressure plate is adapted to occupy a position close to the upper end of the tubular element, to form a cover for said element, and a position above the upper end of said tubular element, by movement perpendicularly along the axis of said element to uncover the upper end thereof. The tubular element is further adapted to pivot about a horizontal shaft near its upper end, between a first position in which the lower end of the tubular element is above a bottom plate and a second position in which the lower end of said element is swung-out laterally so as to clear the bottom plate, whereby compacted matter accumulated in the tubular element can be pressed out by said pressure plate, preferably down into a bag-like means passed over the lower end of the tubular element.

The invention will be described more fully hereinafter, reference being had to the accompanying drawings which illustrate an embodiment of the apparatus in which:

FIG. 2 is an elevational view partly in cross-section of the upper portion of the device shown in FIG. 1 when viewed from the right; and FIG. 2*a* shows in partial cross section a detail of the device shown in FIG. 2 when viewed from the right.

Figure 1:
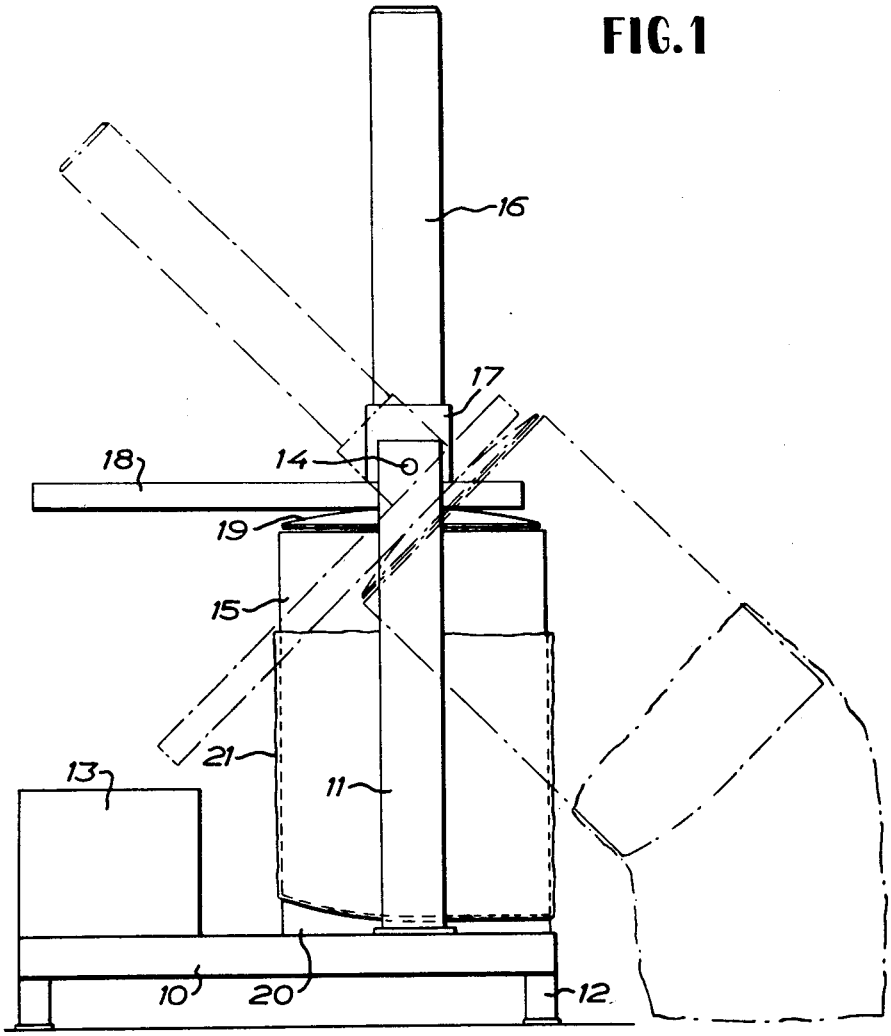
FIG. 1 is a schematic elevational view of the device.

FIG. 1 of the drawing shows a garbage compactor having a support 10 with legs 12 and vertical uprights 11 spaced from each other as shown in FIG. 2. On the support 10 there is also placed a drive unit 13 comprising, for instance, an electric motor for providing hydraulic pressure. At the upper end of the uprights 11 an assembly is pivotally mounted in bearings 14, said assembly comprising a cylindrical tubular element 15, supported by a cradle 15' (FIG 2) which is rotatably supported by the pivots 14. The assembly also consists of a cylinder and piston unit 16, a carriage 17, horizontally disposed rails 18 which are spaced apart as shown in FIG. 2, and a pressure plate 19 operable by the piston unit 16. Rails 18 are rigidly connected to the cradle 15' so they can rotate with it. The cradle 15' is rotated by means of a hand wheel and gear arrangement identified by the reference numeral 22 (FIG. 3) which engages a gear mounted on the cradle 15' for turning the tubular element 15 about the pivot 14. When the handle 22 as shown in FIG. 2*a* is rotated, the screw 22*a* is moved to the left through a nut 22*b* mounted on one of the uprights 11. The screw 22*a* is provided with a bearing 22*c* adjacent the handle 22, which bearing is attached to the cradle 15' by the spindle 22*d* so that when the screw 22*a* is moved to the left, the cradle 15' is rotated about the pivot 14 to the position shown in dash-dot lines in FIG. 1. The carriage 17 and piston unit 16 from an integral unit and can be moved on the rails 18 on wheels 18' between two positions: a first position in which the pressure plate 19 covers the tubular element 15 as in FIG. 3, and a second position in which the carriage 17 abuts an end stop (not shown) on the rails 18 to the left in FIG. 1. The pressure plate 19 is connected with the piston of the cylinder and piston unit 16. Below the cylindrical tubular element there is provided a bottom plate 20 (FIG. 1) the left half of which is curved to correspond with the left-hand curved bottom of the tubular element 15. The reason for this curvature will be explained below. A bag 21 is passed over the tubular element 15 as shown in dotted lines in FIG. 1.

The arrangement of the cylinder and piston unit 16, the carriage 17, the rails 18 and the pressure plate 19 is per se known and is therefore not shown in greater detail. It operates, however, as follows. Displacement of the piston of the piston unit 16 causes the pressure plate 19 associated therewith to reciprocably descend into the tubular element 15. In the position shown in the figures the pressure plate 19 covers the upper end of the element 15 and thus serves as a cover or lid for this element.

When it is desired to place garbage in the tubular element 15 one moves the carriage 17 to the left (FIG. 1) along the rails 18 with the cylinder and piston unit 16 and the pressure plate 19 for uncovering the upper end of the element 15. After the garbage has been placed in the element 15, the carriage 17 is moved with the cylinder and piston unit 16 and the pressure plate 19 back to the position shown in FIG. 1, whereupon the cylinder and piston unit 16 is actuated as described above so that the pressure plate 19 will move down into the tubular element 15 and compact garbage therein against the bottom plate 20.

Figure 3:
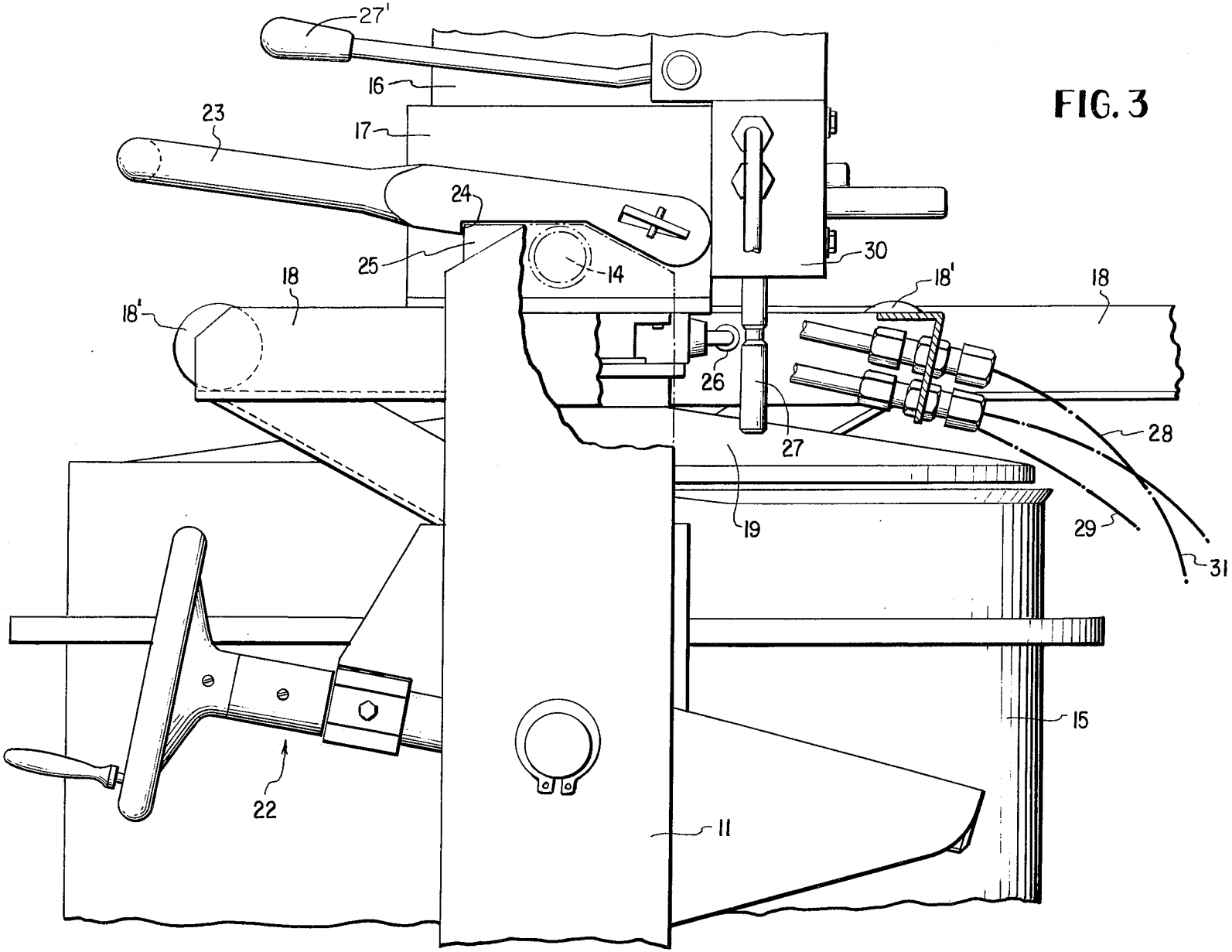
FIG. 3 is an elevational view partly in cross section of a portion of the device shown in FIG. 2 when viewed from the right.

The carriage is automatically locked in this position by a handle 23, which has a recess 24 in its lower part (see FIG. 3). This recess engages a projection 25 and holds the carriage during the compacting stroke and during the later swinging movement for emptying the cylinder. To move the carriage on the rails one only has to lift the handle and push the carriage against an end stop. To ensure that the compacting stroke takes place only when the carriage is in its first position, there is a switch mechanism 26 placed on one of the rails 18. This mechanism is activated when the carriage is in its first position and the handle 27' is moved downwards. The handle 27' is connected to the pin 27 and causes the pin 27 to be raised, and that part of the pin which has a greater diameter contacts the switch mechanism 26. The switch activates the drive unit 13 so that hydraulic oil is fed to the piston unit 16 through the tubes 28 and 29. The amount of oil is regulated by a valve 30. This valve closes when a predetermined pressure has been reached and the oil is returned through tube 31 to the driver unit 13. As shown in FIG. 1, the bottom of the bag 21 is disposed between the bottom plate 20 and the lower end of the element 15. After compaction, the pressure plate 19 is moved upwards to the position shown in the drawing, and serves as a cover.

For emptying the tubular element 15, the assembly 16, 17, and plate 19 are swung in a counterclockwise direction, as shown by broken lines in FIG. 1, about the horizontal pivot 14, whereby the lower end of the element 15 is swung clear of the bottom plate 20. This movement is clockwise when reviewing in FIG. 3. This can take place without any problem, because of the curved portions of plate 20 and cylinder 15 as noted above. In the swung-out position shown in FIG. 1, the cylinder and piston unit 16 is activated and the contents of the receptacle 15 is pressed out by means of the pressure plate 19 into the bag 21 which has previously been passed over the element 15, and said bag is pushed off the element 15. After the compacted garbage has been pressed into the bag 21, the bag is closed and removed, whereafter another bag is passed over the element 15 which will thereupon be swung back to the position shown in full lines in FIG. 1.

From the foregoing description it is apparent that an advantageous and safely operating garbage compactor has been realized in a simple and comparatively inexpensive manner.

What is claimed is:

1. A compactor, particularly for garbage, comprising a support, a tubular element mounted on said support, pressing means including a pressure plate reciprocatable into said tubular element, for compacting garbage therein, a bottom plate beneath said tubular element against which the pressure plate acts for compacting purposes, means for moving said pressure plate to occupy a position close to the upper end of said tubular element, to cover said element, and for moving said pressure plate from the last-mentioned position horizontally with respect to said element to uncover the upper end thereof, horizontal pivot means arranged near the upper end of said tubular element, for pivoting said tubular element about said pivot between a first position in which the lower end of said tubular element is above said bottom plate and a second position in which the lower end of said element is swung-out laterally thereof to clear said bottom plate, whereby compacted matter accumulated in said tubular element can be pressed out of said element by said pressure plate, into a bag-like means disposed over the lower end of said tubular element.

2. A compactor as claimed in claim 1, wherein the boundary surfaces of the bottom plate and the tubular element are curved at least over corresponding halves thereof to permit rotation of said tubular element.

* * * * *